US005573111A

United States Patent [19]

Gordon et al.

[11] Patent Number: 5,573,111

[45] Date of Patent: Nov. 12, 1996

[54] PAPERBOARD BOTTLE CARRIER

[75] Inventors: Robert L. Gordon, Monroe; Linda A. Bernstein, Campbell Hall, both of N.Y.

[73] Assignee: International Paper, Purchase, N.Y.

[21] Appl. No.: 489,884

[22] Filed: Jun. 13, 1995

[51] Int. Cl.[6] ..... B65D 71/40

[52] U.S. Cl. ..... 206/151; 206/158

[58] Field of Search ..... 206/139, 141, 206/145–147, 151–161, 427

[56] References Cited

U.S. PATENT DOCUMENTS

| | | | |
|---|---|---|---|
| 2,654,474 | 10/1953 | Ringler | 206/141 |
| 3,170,570 | 2/1965 | Rice . | |
| 3,317,234 | 5/1967 | Burford | 206/145 |
| 3,524,671 | 1/1968 | Akeireb . | |
| 3,711,143 | 1/1973 | Smed . | |
| 3,834,750 | 9/1974 | Gauntlett . | |
| 4,378,879 | 4/1983 | Killy . | |
| 5,186,321 | 2/1993 | Fadus | 206/151 |
| 5,323,895 | 6/1994 | Sutherland . | |
| 5,474,172 | 12/1995 | Zavatone et al. | 206/158 |

*Primary Examiner*—Jimmy G. Foster

*Attorney, Agent, or Firm*—Michael J. Doyle

[57] ABSTRACT

A bottle carrier having a central or upper panel of paperboard and at least one lower panel or layer. Each panel has a plurality of bottle neck receiving openings. The periphery of each opening of each panel is defined by the tips of a plurality of radially extending fingers, the tips of the fingers of the upper panel engaging beneath a portion of an abutment associated with each bottle neck. Each finger is bent upwardly at about 45 degrees after insertion of a bottle into a respective opening. Each upper panel radial finger is provided at its widest portion with a base slit extending through the paperboard. Another and intermediate slit is located about half way along the length of each upper panel finger, the intermediate slit also extending through the paperboard. The base slit permits bending of each finger upwardly upon bottle insertion, while the intermediate slit facilitates removal of each bottle from its respective opening. The lower panel is provided with reinforcing fingers which are in surface and reinforcing contact with the radially outermost portions only of the upper radial fingers, namely, from the base of each upper finger to its respective intermediate slit. These lower reinforcing fingers permit significant reduction in thickness of the paperboard stock which forms the carrier.

8 Claims, 2 Drawing Sheets

PAPERBOARD BOTTLE CARRIER

BACKGROUND OF THE INVENTION

This invention relates to bottle carriers of the type fashioned from planar sheets of paperboard, the sheets having a plurality of openings for receiving respective bottles. Each bottle receiving opening has a plurality of radially outwardly extending fingers defined by cuts through the paperboard. In general, such carriers have been used largely for cans. Examples of constructions of this general type are shown in U.S. Pat. Nos. 3,834,750 issued to Gauntlett, 3,156,358 issued to Randrup, and 5,125,506 issued to Galbierz et al.

While planar paperboard bottle carriers have been widely employed for carrying cans, such as soft drink cans or the like, they have not been widely accepted for carrying plastic bottles having integral annular flanges around their necks. Generally, the annular flanges associated with bottles, or the screw caps on bottles, are so much larger in diameter than the diameter of the openings in the carrier that it is difficult to remove a bottle from its respective opening.

It is known from copending patent application Ser. No. 08/291,068 by Jonathan T. Beales et al, filed Aug. 17, 1994, and entitled "Paperboard Bottle Carrier", hereby incorporated by reference, that bottle removal from a paperboard carrier is facilitated by providing each of the radially extending fingers of each bottle opening with two parallel slits extending through the paperboard. One slit is termed the base slit and is located at the widest part or base of the finger and the other or intermediate slit is located about half way along the finger length. The slits are at right angles to the longitudinal axis of each finger. The base slit facilitates upward bending of each finger at its base, while the intermediate slit portion of each radial finger defines a frangible area which is relatively easily broken or fractured when a respective bottle is tilted and twisted and pulled downwardly to remove it from the carrier.

SUMMARY OF THE INVENTION

The radial fingers of the noted Beales et al construction of copending application Ser. No. 08/291,068 are weakened at their respective mid lengths by slits. While facilitating bottle withdrawal, such weakening of the radial fingers places a limit on the reduction of thickness of the paperboard from which the bottle carrier is fashioned. It is clearly desirable to make the paperboard as thin as possible to reduce cost.

By the practice of this invention reduction of paperboard thickness is realized by configuring the lower panels or plies of the bottle carrier so as to form lower reinforcing fingers which support the lower portions only of the bottle bead engaging fingers of the upper panel or ply. These lower reinforcing fingers extend from the base of the integral bead engaging upper fingers to respective intermediate slits of these latter fingers. After assembly or mounting of the bottles on the carrier, the reinforcing fingers are sandwiched at angular positions between lower portions of the bead engaging upper fingers and the bottle necks.

U.S. Pat. No. 5,323,895 issued to Sutherland et al discloses a somewhat similar bottle carrier, also having upper and lower bottle neck receiving plies, with bottle bead engaging radial fingers. In that construction however, the tips of the fingers of both the upper and lower plies engage the integral bottle neck beads or rings. Further, this Sutherland construction does not employ intermediate slits to define a frangible area or zone along each radial finger to facilitate bottle removal from the carrier.

DETAILED DESCRIPTION OF THE INVENTION

Figure 1:
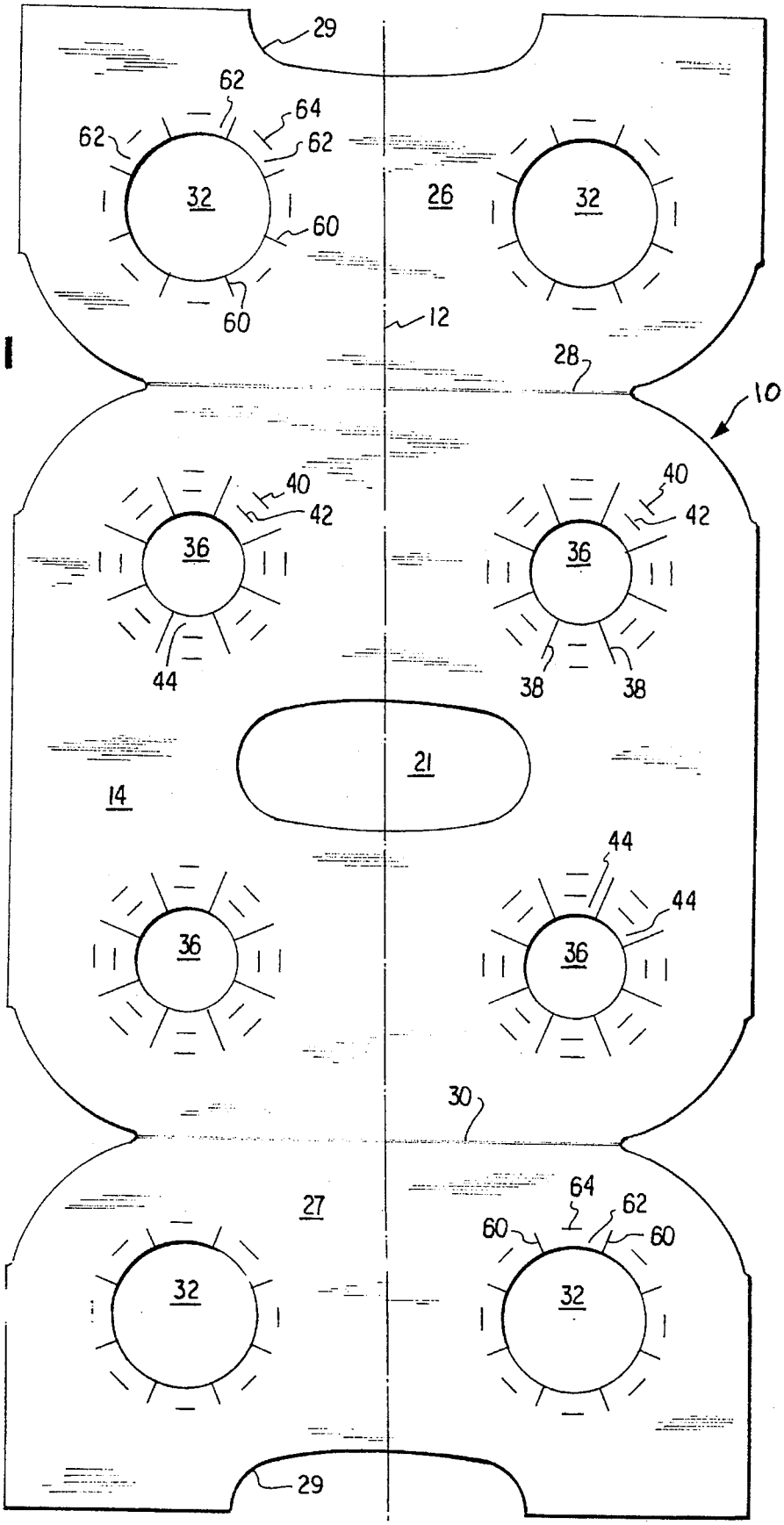
FIG. 1 is a plan view of a unitary blank of paperboard or other stiff, foldable, and resilient sheet material from which the bottle carrier of this invention is fashioned.

Referring now to FIG. 1 of the drawings, a unitary blank of paperboard or other stiff, foldable and resilient sheet material is denoted as 10. Blank 10 is generally rectangular and is mirror symmetrical to the left and right with respect to a vertical or longitudinal axis 12. Central or upper panel 14 is provided at its center with a finger carrying opening 21. Each quadrant of panel 14 is provided with a bottle receiving opening 36 whose periphery is defined by the radially innermost tips of radial fingers made by radial slits 38 extending through the paperboard. The base or widest portion of each finger is provided with a base slit 40. Another and intermediate slit 42 is located about half way along the length of each radial finger 44, with slits 40 and 42 being parallel to each other, both extending through the paperboard, and located midway of the width of a respective radial finger. A typical dimension of panel 14 is 5.625 inches on each side, as from fold line 28 to fold line 30, and a typical length of slits 40 and 42 is 0.125 inches. Openings 32 are typically 1.8125 inches in diameter. Edge notches 29 in end panels 26 and 27 are congruent to opening 21 when the end panels are folded downwardly.

End panels 26 and 27 each carry two openings 32 whose respective peripheries are radially intersected by radial cuts 60. Angularly spaced reinforcing fingers 62 are defined by cuts 60. Each reinforcing finger 62 has a base cut 64 extending through the paperboard, similar to cuts 40 of main or upper panel 14. Base cuts 64 facilitate upward bending of reinforcing fingers 62. The diameter of openings 32 is that of the diametrical distance between opposed intermediate cuts 42 of fingers 44.

Figure 2:
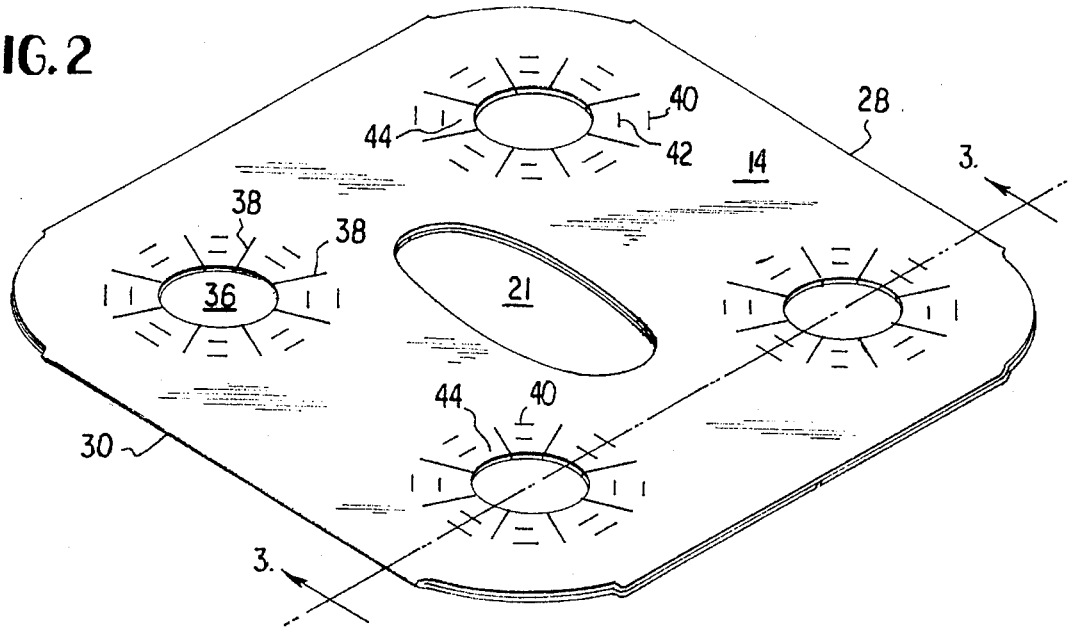
FIG. 2 is a view similar to FIG. 1 and shows the blank of FIG. 1 after its end panels have been folded downwardly and glued, ready to be loaded with bottles.

Referring now to FIG. 2, the blank of FIG. 1 has been folded about fold lines 28 and 30, with end panels 26 and 27 glued against the bottom surface of upper panel 14. Openings 32 of panels 26 and 27 are coaxial with respective bottle openings 36 in panel 14. Lower panels 26 and 27 reinforce upper panel 14. Each finger 62 of the lower or end panels is beneath, partially congruent, and aligned with a respective finger 44 of upper panel 14. The diameter of openings 32 of lower panels 26 and 27 is substantially the same as the diameter of an imaginary circle which contains frangible portions 42 of upper fingers 44. In order to permit relative sliding of the upper and lower fingers upon bending upwardly of these fingers, shortly to be described, the upper and lower fingers are not glued together, although they are in surface contact with each other.

Figure 3:
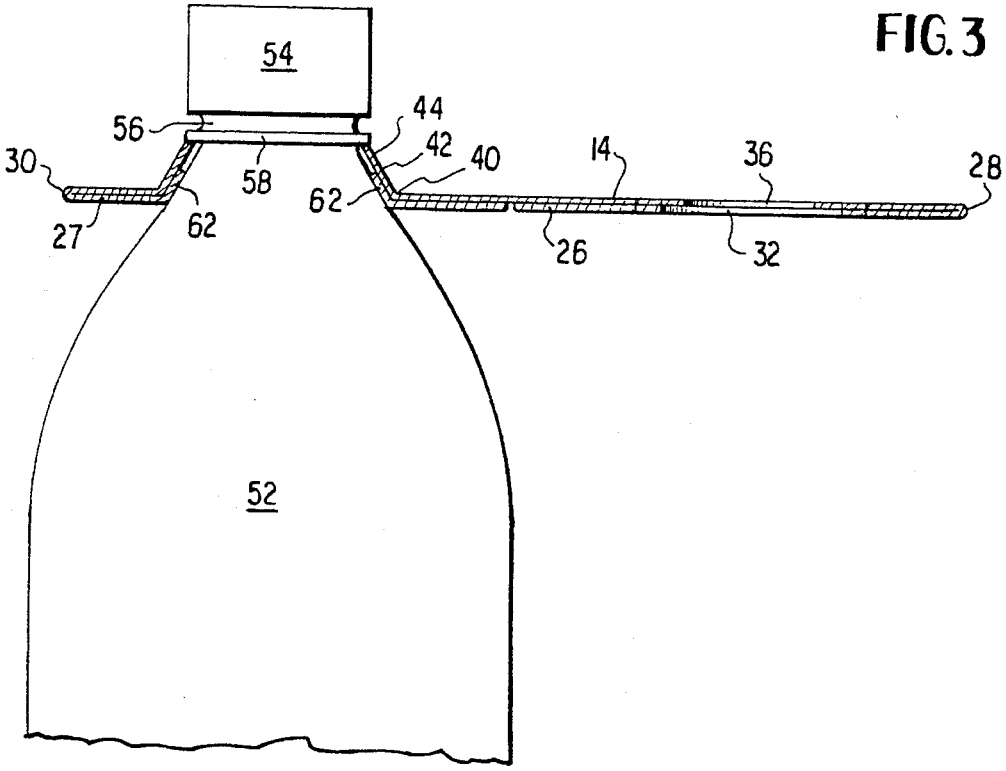
FIG. 3 is a view taken along section 3—3 of FIG. 2 and illustrates a plastic bottle, having an integral neck bead, inserted into the carrier.

FIG. 3 illustrates one of a plurality of plastic bottles 52, the others not shown, each typically formed by blow molding from polyethylene terephthalate (PET), then filled with product and loaded in the carrier. Each bottle, typically, is provided with a screw cap 54, a neck 56 and an enlarged and integral bead or ring 58 around its neck. For loading, the carrier is moved downwardly relative to the bottles, with each bottle upper portion passing upwardly relative to the plane of panel 14. The extent of the motion is such that upon completion of the loading, the tips of upper radial fingers 44 engage the bottom of a respective bottle bead or ring 58. This relation is maintained by the weight of the bottles, with the fingers 44 being under lengthwise compression and slanted upwardly with respect to the plane of panels 14, 26 and 27. The carrier is lifted (as from a retail display shelf) and carried by the purchaser inserting his fingers into opening 21 and folded under partial openings 29. While shown as at right angles to the length of each finger 44, slits 40 and 42 may be slanted so as to be at an angle with respect to the longitudinal axis of each upper radial finger. Further, the slits 40 and 42 need not be parallel to each other. It will be noted that the diameter of caps 54 is greater than the diameter of bottle openings 36, but less than the spacing between diametrically opposite pairs of base slits 40 of any upper opening 36. Each respective reinforcing finger 62 extends from the plane of lower panels 26 and 27 angularly upwardly to a respective cut 42 on a respective finger 44. It is seen that the lower portion of each finger 44 is reinforced by respective reinforcing finger 62. In the assembled form of the carrier of FIG. 2, the periphery of each opening 32 is substantially tangent to intermediate slits 42 of openings 36.

When the consumer desires to disengage a bottle from the carrier, the bottle is grasped, tilted, twisted, and pulled downwardly. These motions result in a fracture of several of the associated radial fingers 44 at the region of intermediate slits 42, thus facilitating bottle removal.

In the event that a particular bottle design does not include ring or bead 58 on its neck, the tips of fingers 44 would then abut either the lower rim of cap 54 or would abut the bottoms of the screw threads (not illustrated) on the top of the bottle neck. According to the invention, the exact form of the abutment associated with each bottle neck 56 and engaged by the free ends or tips of fingers 44, namely, ring 58, or the bottom of cap 54, or the bottom of the screw threads, is not critical.

The number of upper radial fingers 44, the extent of radial cuts 38, and the number of openings 36 may all be varied for particular bottle weights and designs. It will be observed that the length of slits 40 and 42 is about one third of the width of any radial finger 44 at the respective locations of the slits, but this proportion may be varied. The length of slits 40 must be sufficient to facilitate bending at the finger bases, while the length of slits 42 must be sufficient to permit fracture in their regions.

While blank 10 is shown as having a single upper panel 14 and two lower end panels 26 and 27, it may be formed of a single upper panel and a single lower panel. For ease in fabrication, the upper and lower panels are integral but may be made separate. Further, central panel 14 may be provided with openings 32 and associated fingers while end panels 26 and 27 provided with openings 36 and associated fingers, with thus modified end panels 26 and 27 folded on top of thus modified central panel 14.

The practice of this invention permits a reduction of thickness of the paperboard for the same weight bottles, typically, from a paperboard stock of about 110 to 130 pounds per 1000 square feet to a stock of about 90 to 100 pounds per 1000 square feet.

Geometrical terms of orientation, such as upper, lower and the like, are used to facilitate the description.

We claim:

1. A bottle carrier formed from a unitary paperboard blank, said blank including an upper panel having a plurality of bottle neck receiving openings, said upper panel openings each having a plurality of cut lines extending through said paperboard and extending radially outwardly from said respective openings to thereby define a plurality of radially extending upper fingers, tips of said radially extending upper fingers terminating at respective said openings, each of said radially extending upper fingers having a base slit at its base or widest portion, each of said radially extending upper fingers having an intermediate slit about midway along its length, said blank including a reinforcing, apertured lower paperboard panel folded and glued beneath said upper panel, said reinforcing, apertured lower panel having openings which are concentric with respective said openings of said upper panel, each of said openings of said lower reinforcing panel having radially extending reinforcing fingers therearound, said reinforcing lower fingers being congruent with portions only of said upper panel fingers, said reinforcing lower fingers extending from said lower reinforcing panel and terminating at respective said intermediate slits of respective said upper panel fingers, said lower reinforcing fingers being in surface contact with respective said upper fingers.

2. The carrier of claim 1 wherein said base and intermediate slits of said upper fingers extend through said paperboard panel.

3. The carrier of claim 1 wherein said base and intermediate slits of said upper fingers are parallel to each other, said slits being generally at right angles to the length of each said radially extending finger.

4. The carrier of claim 1 including a bottle having a neck, said neck extending through one of said openings, an abutment contiguous to said neck, said tips of said upper radial fingers engaging said abutment, said radially extending upper fingers and said reinforcing fingers tilted upwardly with respect to said upper panel.

5. The carrier of claim 1 including means on said carrier to facilitate carrying it by a consumer.

6. The carrier of claim 5 wherein said means is defined by a central opening in said upper panel through which the fingers of a consumer can be inserted.

7. A bottle carrier having upper and lower paperboard panels, said paperboard upper panel having a plurality of bottle neck receiving upper openings each annularly surrounded by radially extending upper fingers having tips terminating at respective said upper openings, each said upper finger also having a base remote from its tip, each said upper finger having a slit between its tip and its base, said lower layer having a plurality of bottle receiving lower openings concentric with respective said upper openings, each said lower opening surrounded by radially extending lower, reinforcing fingers having tips terminating at respective said lower openings, the diameter of said lower openings being substantially the same as the diameter of an imaginary circle on which said slits of said upper fingers lie.

8. The carrier of claim 7 wherein said upper and lower paperboard panels are in surface contact with each other and wherein.

* * * * *